US007263725B2

(12) United States Patent
Fleury

(10) Patent No.: US 7,263,725 B2
(45) Date of Patent: Sep. 4, 2007

(54) DISPOSABLE TOWEL FOR USE AS A BIB OR FOREARM NAPKIN

(76) Inventor: Patricia L. Fleury, 6062 Fireside Dr., Rockford, IL (US) 68169

( * ) Notice: Subject to any disclaimer, the term of this patent is extended or adjusted under 35 U.S.C. 154(b) by 0 days.

(21) Appl. No.: 11/341,266

(22) Filed: Jan. 27, 2006

(65) Prior Publication Data

US 2007/0174942 A1 Aug. 2, 2007

(51) Int. Cl.
*A41B 13/10* (2006.01)

(52) U.S. Cl. ..... 2/49.1; 2/52; 2/59

(58) Field of Classification Search ..... 2/46, 2/47, 48, 49.1–49.5, 50, 51, 52, 88, 114, 53, 2/58, 59, 16, 60–62; 383/37, 7, 13, 207, 383/209

See application file for complete search history.

(56) References Cited

U.S. PATENT DOCUMENTS 3,146,465 A * 9/1964 Hummel ..... 2/49.3
3,229,875 A * 1/1966 Stoller ..... 225/38
3,332,547 A * 7/1967 Rowe et al. ..... 206/526
3,793,644 A * 2/1974 Kellner ..... 2/48
4,118,802 A * 10/1978 Polster ..... 2/84
4,186,443 A * 2/1980 Britzman ..... 2/49.1
4,441,212 A * 4/1984 Ahr et al. ..... 2/49.2
4,622,698 A * 11/1986 Heyman et al. ..... 2/48
4,849,090 A * 7/1989 Case et al. ..... 206/390
4,884,299 A * 12/1989 Rose ..... 206/390
4,893,372 A 1/1990 Wenzel
5,187,813 A 2/1993 Klein
5,222,257 A * 6/1993 Bachor ..... 2/51
5,552,200 A 9/1996 Gureff
5,644,793 A 7/1997 Lahaussois et al.
5,809,568 A * 9/1998 Morris-Jones ..... 2/49.1
5,930,837 A * 8/1999 Anvar ..... 2/49.1
6,196,717 B1 * 3/2001 Belias et al. ..... 383/37
6,212,683 B1 * 4/2001 Liebmann ..... 2/49.4
6,243,867 B1 6/2001 Faison
6,401,247 B1 6/2002 Williams, IV
2004/0199975 A1 * 10/2004 Kehrli et al. ..... 2/69
2007/0028343 A1 * 2/2007 Makowka ..... 2/48

* cited by examiner

*Primary Examiner*—Amy B. Vanatta
(74) *Attorney, Agent, or Firm*—Dale J. Ream

(57) ABSTRACT

A disposable towel includes at least one generally rectangular sheet having multiple lines of weakness arranged such that the towel may be selectively converted into a bib and a forearm protector. The towel includes first, second, third, and fourth lines of weakness that may be torn to separate the portions. Multiple sheets may be connected in a roll whereby each sheet may be removed as needed or multiple sheets may be removed while connected together if a longer bib length is desired. The lines of weakness are arranged such that a two-sheet combination may be changed into a single bib and forearm protector or into a pair of forearm protectors. The sheets include strategically positioned fasteners for coupling the bib and forearm protector portions.

18 Claims, 3 Drawing Sheets

DISPOSABLE TOWEL FOR USE AS A BIB OR FOREARM NAPKIN

BACKGROUND OF THE INVENTION

The present invention relates generally to towels and napkins and, more particularly, to a disposable towel for use as a bib or forearm napkin.

Bibs are commonly used for keeping food from soiling the clothing of an infant or toddler. Napkins are frequently used by older children and adults for a similar purpose. However, toddlers often have a tendency to wipe their faces with their hand or forearm rather than to use a napkin for that purpose. Further, the need to protect a child's clothing while traveling in a vehicle is sometimes a frustrating act of futility for parents or caregivers.

Various devices have been proposed in the art for protecting a child's forearm or for protecting the child's shirt in general, such as the devices disclosed in U.S. Pat. Nos. 5,644,793, 5,187813, and 6,401,247. Bibs for covering a child's shirt are also known. Although assumably effective for their intended purposes, the existing devices do not provide disposable towels having multiple lines of weakness such that a single sheet may be used for both a bib and a forearm protector simultaneously and disposed of when finished.

Therefore, it would be desirable to have a towel having a generally rectangular configuration that is selectively convertible into both a bib and a forearm protector. Further, it would be desirable to have a towel that includes a portion for attachment about a child's neck and a portion for attachment about a child's forearm. Still further, it would be desirable to have a towel that is disposable and that can be part of a roll of towels for convenient usage.

SUMMARY OF THE INVENTION

Therefore, a towel according to the present invention includes a generally rectangular sheet that may include absorbent and a soft/comfortable layer with a waterproof layer sandwiched therebetween. Each sheet includes first, second, third, and fourth lines of weakness, wherein these lines may be perforated such that a user may tear the sheets therealong. The lines of weakness are arranged on each sheet such that a generally rectangular section may be torn from the sheet and utilized as a forearm protector. The remaining portion of the torn sheet includes a configuration that may be tied about a child's neck and utilized as a napkin. Fasteners such as snaps, hook and loop, adhesive or other fasteners are provided at predetermined locations on each sheet for selectively attaching portions of the sheet about a child's neck or forearm. Both portions are constructed of a disposable material that may be thrown away following use.

Therefore, a general object of this invention is to provide a disposable towel that may be selectively utilized as a bib, forearm protector, or both simultaneously.

Another object of this invention is to provide a disposable towel, as aforesaid, having multiple lines of weakness that may be separated to form a bib portion and a forearm portion.

Still another object of this invention is to provide a disposable towel, as aforesaid, which may include a continuous roll of towel sheets.

Yet another object of this invention is to provide a disposable towel, as aforesaid, having fasteners positioned at predetermined positions for selectively attaching the bib and forearm portions about a child's neck and forearm, respectively.

A further object of this invention is to provide a disposable towel, as aforesaid, having a variable length dimension depending on the quantity of connected sheets utilized together.

A still further object of this invention is to provide a disposable towel, as aforesaid, in which the towel may be selectively separated into bib and forearm portions depending on which lines of weakness are torn.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
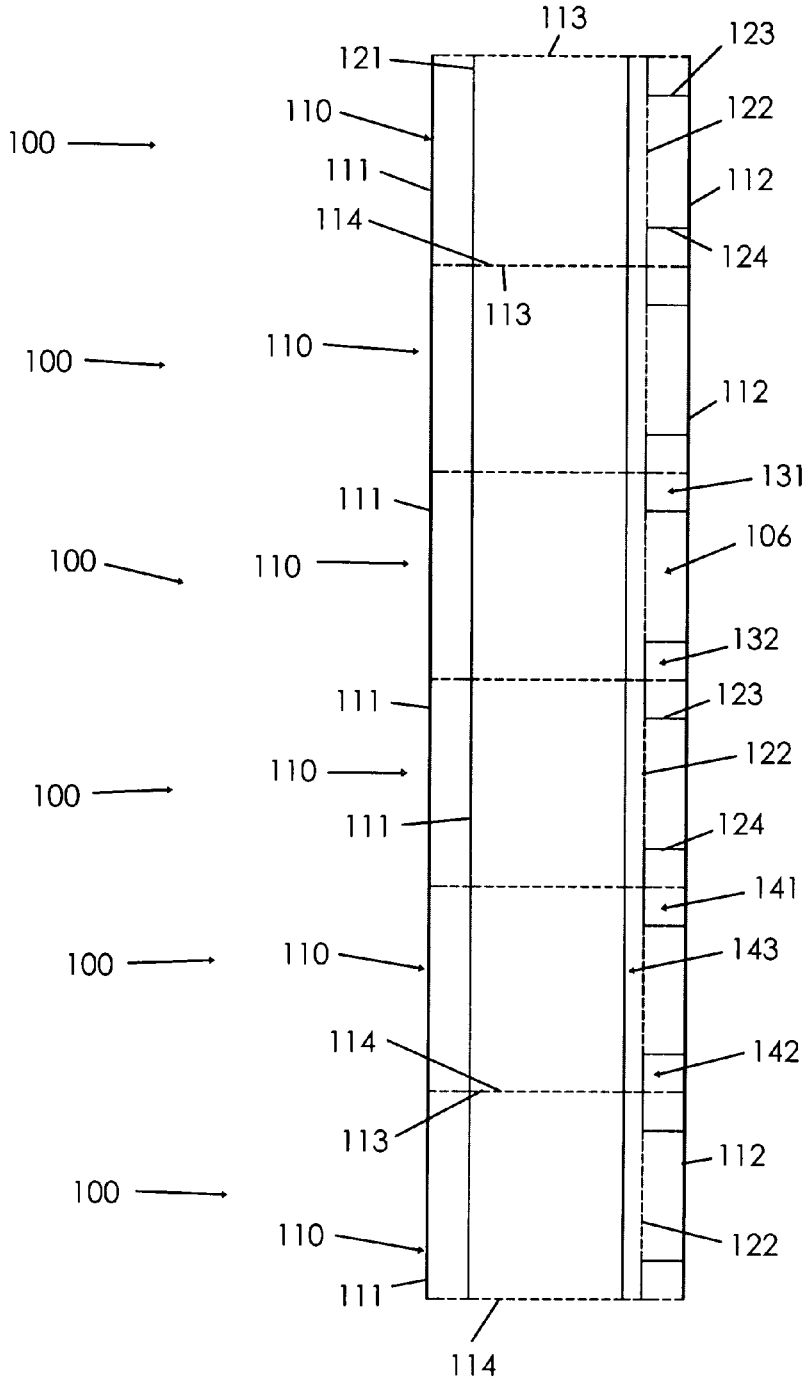
FIG. 1 is a front view of a plurality of disposable towels removably connected together according to a preferred embodiment of the present invention.

A disposable towel 100 for selective use as a bib or as a forearm napkin according to the present invention will now be described in detail with reference to FIGS. 1 through 3*b* of the accompanying drawings. More particularly, a disposable towel 100 for selective use as a bib or as a forearm napkin according to the current invention includes a generally rectangular sheet 110, and a plurality of sheets 110 may be interconnected.

As shown throughout the drawings, each sheet 110 preferably includes opposed first and second edges 111, 112 generally perpendicular to opposed third and fourth edges 113, 114. A first line of weakness 121 is preferably in each sheet 110 generally parallel to and adjacent the first edge 111 of the respective sheet 110. A second line of weakness 122 is preferably in each sheet 110 generally parallel to and adjacent the second edge 112 of the respective sheet 110. A third line of weakness 123 is preferably in each sheet 110 generally parallel to and adjacent the third edge 113 of the respective sheet 110, and each third line of weakness 123 preferably extends from the second edge 112 to the second line of weakness 122 of each respective sheet 110. A fourth line of weakness 124 is preferably in each sheet 110 generally parallel to and adjacent the fourth edge 114 of the respective sheet 110, and each fourth line of weakness 124 preferably extends from the second edge 112 to the second line of weakness 122 of each respective sheet 110. The first, second, third, and fourth lines of weakness 121, 122, 123, 124 may include perforations, for example.

Though each sheet 110 may include only a single layer of material, it is currently preferred that each sheet 110 include multiple layers of material. More particularly, each sheet 110 may include an absorbent layer (i.e., a quilted fiber) and a waterproof layer (i.e., a plastic film). A comfort layer may be further included so that the sheet 110 does not irritate a user's skin. If each sheet 110 includes the absorbent layer, the waterproof layer, and the comfort layer, the waterproof layer is preferably sandwiched between the absorbent layer and the comfort layer. The absorbent layer and the comfort layer may or may not be constructed of the same material, and though each sheet 110 may be substantially identical to each other sheet 110, this is not required. "Substantially identical" does not include indicia (such as decorative print) or minor inconsistencies from sheet 110 to sheet 110.

Figure 2B:
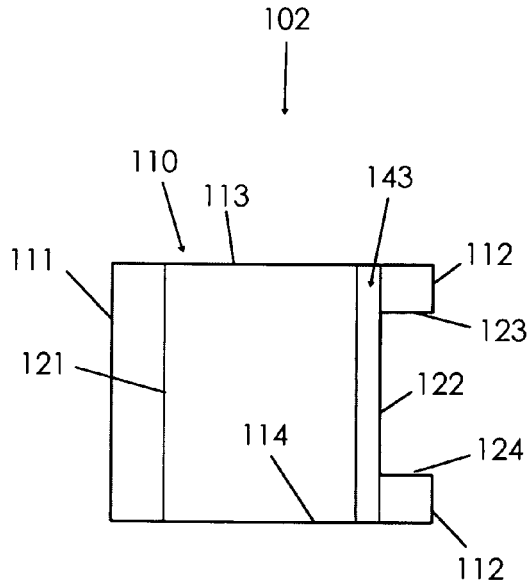
FIG. 2*b* is a front view of the removed forearm portion as in FIG. 2*a;*
Figure 3A:
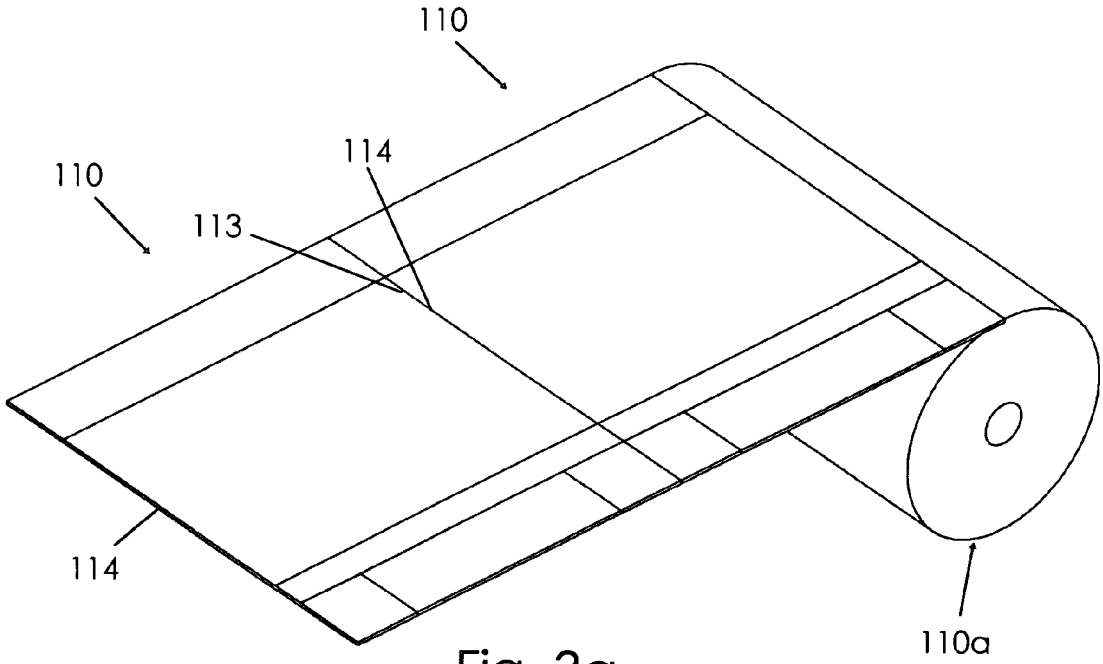
FIG. 3*a* is a perspective view of a plurality of removably connected disposable towels arranged in a roll configuration.
Figure 3B:
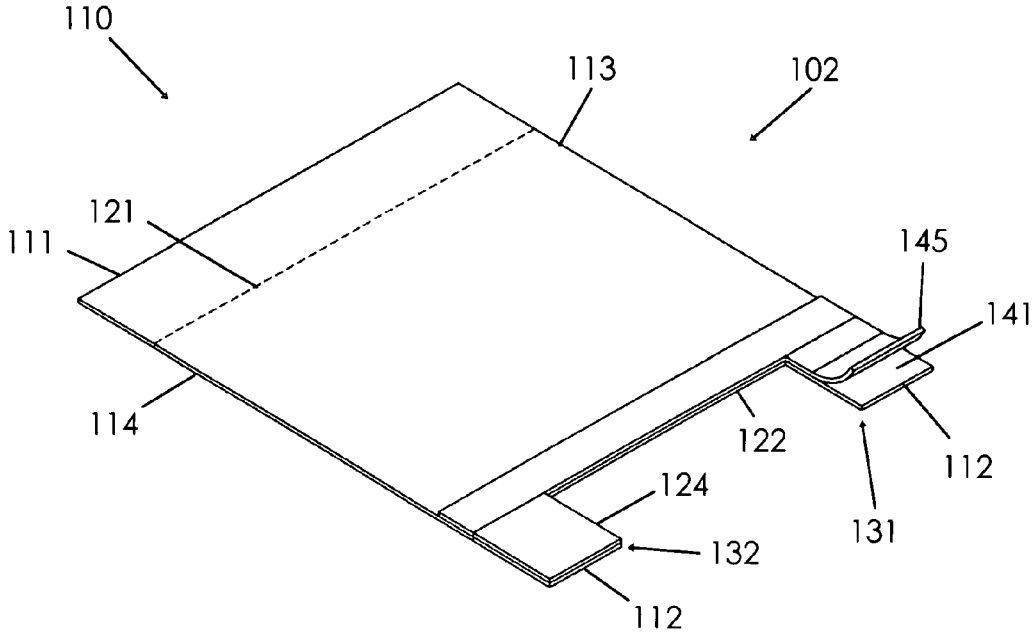
FIG. 3*b* is perspective view of a single towel as in FIG. 3*a* showing a three layer construction.

The second edge 112, the third edge 113, the second line of weakness 122, and the third line of weakness 123 of each sheet 110 may collectively define a first corner area 131 (FIGS. 1 and 3*b*). The second edge 112, the fourth edge 114, the second line of weakness, 122, and the fourth line of weakness 124 of each sheet 110 may collectively define a second corner area 132. As shown in FIG. 1, the first corner area 131 may include a first fastener 141 (such as adhesive, a hook and loop fastener, or a snap fastener, for example) and the second corner area 132 may include a second fastener 142 (such as adhesive, a hook and loop fastener, or a snap fastener, for example). A respective third fastener 143 may be located adjacent the second line of weakness 122 of each sheet 110 between the respective second line of weakness 122 and the first edge 111 (FIG. 2*b*). The third fasteners 143 may include respective strips of adhesive extending from the third edge 113 to the fourth edge 114 of each sheet 110. While the first, second, and third fasteners 141, 142, 143 are preferably adhesive, it should be understood that other fasteners (including fasteners not specifically discussed herein) may alternatively be used. If the first, second, and third fasteners 141, 142, 143 are adhesive, however, they may include a separable covering layer 145 (FIG. 3*b*) that allows the adhesive to be selectively exposed.

Figure 2A:
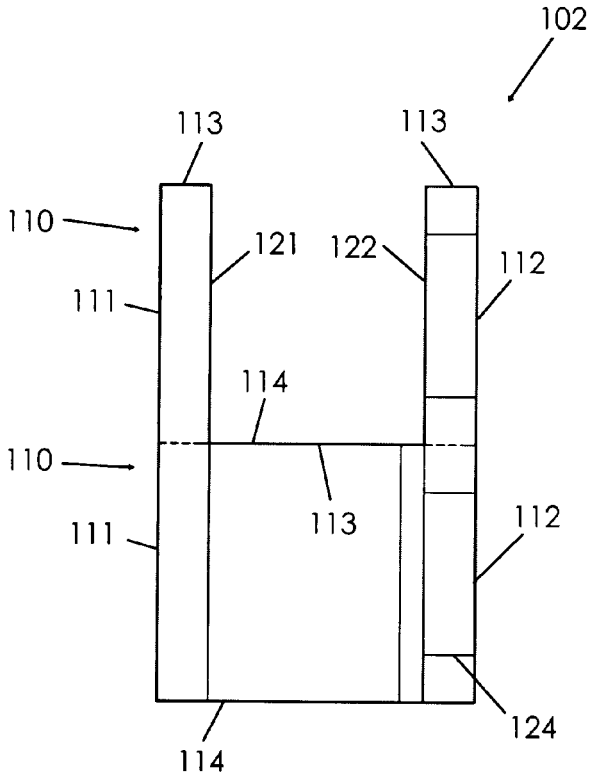
FIG. 2*a* is a front view of connected towels as in FIG. 1 in a bib configuration with a forearm portion removed.

As shown in FIGS. 1, 2*a*, and 3*a*, a plurality of sheets 110 may be interconnected, and the interconnected sheets 110 may collectively define a roll 110*a* (FIG. 3*a*). When a plurality of sheets 110 are interconnected, a third edge 113 of one sheet 110 may be adjacent a fourth edge 114 of another sheet 110, and multiple sheets 110 may be interconnected in this configuration. Interconnected sheets 110 may be constructed as adjoining, and adjoining third and fourth edges 113, 114 may be defined by respective lines of weakness so that each sheet 110 is separable from all other sheets 110.

In use, bibs 102 and forearm napkins 104 may be created from one or more sheet(s) 110 in different ways. In one way, a sheet 110 may provided as a single sheet 110 or separated from every other sheet 110. The single sheet 110 may be severed along its third line of weakness 123, along its fourth line of weakness 124, and along its second line of weakness 122 from its third line of weakness 123 to its fourth line of weakness 124 to separate a bib 102 (FIG. 2*b*) and a separate spare portion 104 that may be used as a napkin. The bib 102 is preferably sized such that it is attachable about a child's neck by the first and second fasteners 141, 142. The single sheet 110 may alternately be severed along its second line of weakness 122 from its third edge 113 to its fourth edge 114 to create a forearm napkin 104 from its second line of weakness 122 to its first edge 111. The third fastener 143 may be used to secure the forearm napkin 104 around a child's forearm.

Figure 2C:
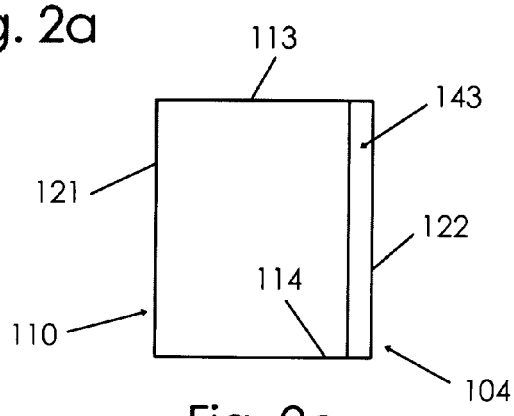
FIG. 2*c* is a front view of another portion of the towel as in FIG. 2*a* for use as another forearm portion.

In another way (shown in FIG. 2*a*) two or more sheets 110 may be isolated from every other sheet 110 so that a third edge 113 of one isolated sheet 110 is not in contact with a fourth edge of any sheet 110 and so that the fourth edge 114 of another isolated sheet 110 is not in contact with a respective third edge 113 of any sheet 110. The sheet 110 having the third edge 113 that is not in contact with a fourth edge 114 may then be severed along its first line of weakness 121, its second line of weakness 122, and its fourth edge 114 from its first line of weakness 121 to its second line of weakness 122 to separate a bib 102 (FIG. 2*a*) and a forearm napkin 104 (FIG. 2*c*). By isolating more than two sheets 110, the length of the bib 102 may be lengthened, and the sheets 110 are preferably sized such that the bib 102 and the napkin 104 may be attached about a user's neck and forearm, respectively. It is notable that there is minimal waste when using a bib 102 or a forearm napkin 104 defined by one or more sheet 110.

It is understood that while certain forms of this invention have been illustrated and described, it is not limited thereto except insofar as such limitations are included in the following claims and allowable functional equivalents thereof.

What is claimed is:

1. A disposable towel for selective use as a bib or as a forearm napkin, said towel comprising:

a generally rectangular sheet having opposed first and second edges generally perpendicular to opposed third and fourth edges;

a first line of weakness in said sheet generally parallel to and adjacent said first edge;

a second link of weakness in said sheet generally parallel to and adjacent said second edge;

a third line of weakness in said sheet generally parallel to and adjacent said third edge and extending from said second edge to said second line of weakness; and a fourth line of weakness in said sheet generally parallel to and adjacent said fourth edge and extending from said second edge to said second line of weakness; wherein a first corner area is collectively defined by said second edge, said third edge, said second line of weakness, and said third line of weakness;

a second corner area is collectively defined by said second edge, said fourth edge, said second line of weakness, and said fourth line of weakness;

said first corner area includes a first fastener; and said second corner area includes a second fastener.

2. The towel as in claim 1, wherein said sheet includes an absorbent layer and a waterproof layer.

3. The towel as in claim 2, wherein:

said sheet further includes a comfort layer; and said waterproof layer is sandwiched between said absorbent layer and said comfort layer.

4. The towel as in claim 1, wherein a third fastener is located adjacent said second line of weakness between said second line of weakness and said first edge.

5. The towel as in claim 1, wherein a strip of adhesive is located adjacent said second line of weakness between said second line of weakness and said first edge.

6. The towel as in claim 5, wherein said strip of adhesive extends from said third edge to said fourth edge.

7. The towel as in claim 5, wherein:

said first fastener is a first adhesive fastener;

said second fastener is a second adhesive fastener; and said first adhesive fastener, said second adhesive fastener, and said strip of adhesive respectively include a separable covering layer.

8. The towel as in claim 5, wherein severing said sheet along said second line of weakness from said third edge to said fourth edge defines a forearm napkin from said second line of weakness to said first edge.

9. The towel as in claim 1, wherein severing said sheet along said third line of weakness, along said fourth line of weakness, and along said second line of weakness from said third line of weakness to said fourth line of weakness defines a bib and a separate spare portion.

10. The towel as in claim 9, wherein said bib is sized such that said bib is attachable about a child's neck by said first and second fasteners.

11. The towel as in claim 1, wherein said first, second, third, and fourth lines of weakness respectively include perforations.

12. A plurality of interconnected disposable towels for selective use as a bib or as a forearm napkin, said plurality of interconnected disposable towels comprising a plurality of generally rectangular sheets, each sheet having:

opposed first and second edges generally perpendicular to opposed third and fourth edges;

at least one of said third edge and said fourth edge adjacent a fourth edge or a third edge, respectively, of another respective sheet;

a first line of weakness generally parallel to and adjacent said first edge;

a second line of weakness generally parallel to and adjacent said second edge;

a third line of weakness generally parallel to and adjacent said third edge and extending from said second edge to said second line of weakness; and a fourth line of weakness generally parallel to and adjacent said fourth edge and extending from said second edge to said second line of weakness.

13. The plurality of interconnected disposable towels as in claim 12, wherein:

each said sheet is separable from all other said sheets; and a bib and a separate spare portion are defined by separating a respective sheet from all other said sheets, severing said respective sheet along said third line of weakness, along said fourth line of weakness, and along said second line of weakness from said third line of weakness to said fourth line of weakness.

14. The plurality of interconnected disposable towels as in claim 13, wherein:

each said sheet is substantially identical to each other said sheet;

each said sheet has a first corner area collectively defined by said second edge, said third edge, said second line of weakness, and said third line of weakness;

each said sheet has a second corner area collectively defined by said second edge, said fourth edge, said second line of weakness, and said fourth line of weakness;

each said first corner area includes a fastener; and each said second corner area includes a fastener.

15. The plurality of interconnected disposable towels as in claim 12, wherein:

each said sheet is separable from all other said sheets; and a forearm napkin is defined by separating a respective sheet from all other said sheets and severing said respective sheet along said second line of weakness from said third edge to said fourth edge.

16. The plurality of interconnected disposable towels as in claim 15, wherein each said sheet has strip of adhesive located adjacent said second line of weakness between said second line of weakness and said first edge.

17. The plurality of interconnected disposable towels as in claim 12, wherein each said sheet is sized such that a bib and a forearm napkin may be defined by:

isolating two or more said sheets from every other said sheet so that said third edge of one isolated sheet is not in contact with a respective fourth edge of any said sheet and so that said fourth edge of another isolated sheet is not in contact with a respective third edge of any said sheet; and severing said sheet having said third edge not in contact with a respective fourth edge of any said sheet along said first line of weakness, said second line of weakness, and said fourth edge from said first line of weakness to said second line of weakness.

18. The plurality of interconnected disposable towels as in claim 12, wherein said sheets collectively define a roll.

* * * * *